US006901644B1

(12) United States Patent
Rich

(10) Patent No.: US 6,901,644 B1
(45) Date of Patent: Jun. 7, 2005

(54) PIVOT PIN REMOVING TOOL

(76) Inventor: John W. Rich, 228 69th St. North, Clear Water, FL (US) 33764

( * ) Notice: Subject to any disclaimer, the term of this patent is extended or adjusted under 35 U.S.C. 154(b) by 0 days.

(21) Appl. No.: 10/661,424

(22) Filed: Sep. 15, 2003

(51) Int. Cl.[7] ..... B25B 27/14
(52) U.S. Cl. ..... 29/275
(58) Field of Search ..... 29/275, 276, 270, 29/278, 254, 253, 255, 280; 254/25, 131

(56) References Cited

U.S. PATENT DOCUMENTS 4,188,701 A 2/1980 Ludwig
4,817,917 A * 4/1989 Stultz et al. ..... 254/30
5,054,180 A 10/1991 Combs
5,140,741 A * 8/1992 Bible ..... 29/426.6
5,435,030 A 7/1995 Phillips
5,438,743 A 8/1995 Simington et al.
5,695,172 A 12/1997 Hreha
5,875,535 A 3/1999 Canoy

* cited by examiner

*Primary Examiner*—Robert C. Watson

(57) ABSTRACT

A pivot pin removing tool for removing a pivot pin from a hinge includes a primary plate that has a front side, a back side, a top edge, a bottom edge and a pair of lateral edges. A rigid panel is attached to the top edge and extends away from the front side at a generally perpendicular angle with respect to a longitudinal axis of the primary plate. The panel has a forward edge having a slot extending therein. The slot is adapted for receiving a body portion of the pivot pin. The forward edge is angled back from a bottom side to a top side of the panel.

6 Claims, 1 Drawing Sheet

PIVOT PIN REMOVING TOOL

BACKGROUND OF THE INVENTION

1. Field of the Invention

The present invention relates to pivot pin removal devices and more particularly pertains to a new pivot pin removal device for removing a pivot pin from a hinge.

2. Description of the Prior Art

The use of pivot pin removal devices is known in the prior art. While these devices fulfill their respective, particular objectives and requirements, the need remains for a device that is simple and effective in its usage.

SUMMARY OF THE INVENTION

The present invention meets the needs presented above by comprising a primary plate that has a front side, a back side, a top edge, a bottom edge and a pair of lateral edges. A rigid panel is attached to the top edge and extends away from the front side at a generally perpendicular angle with respect to a longitudinal axis of the primary plate. The panel has a forward edge having a slot extending therein. The slot is adapted for receiving a body portion of the pivot pin. The forward edge is angled back from a bottom side to a top side of the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
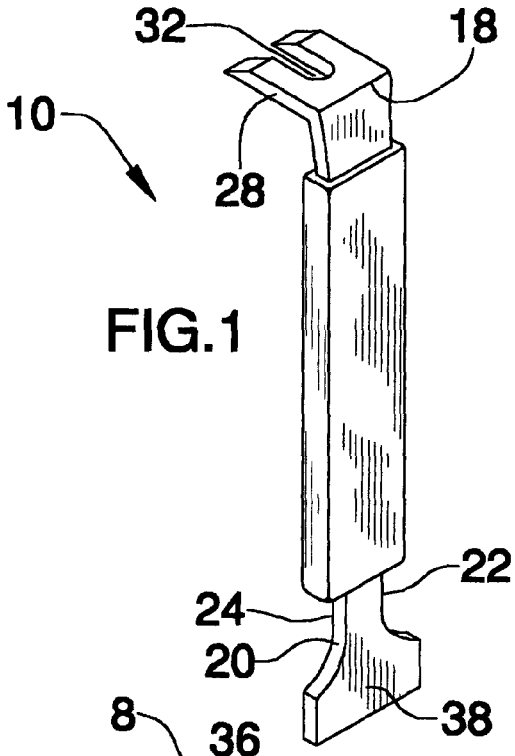
FIG. 1 is a schematic perspective view of a pivot pin removing tool according to the present invention.
Figure 3:
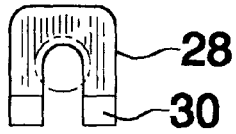
FIG. 3 is a schematic top view of the present invention.
Figure 2:
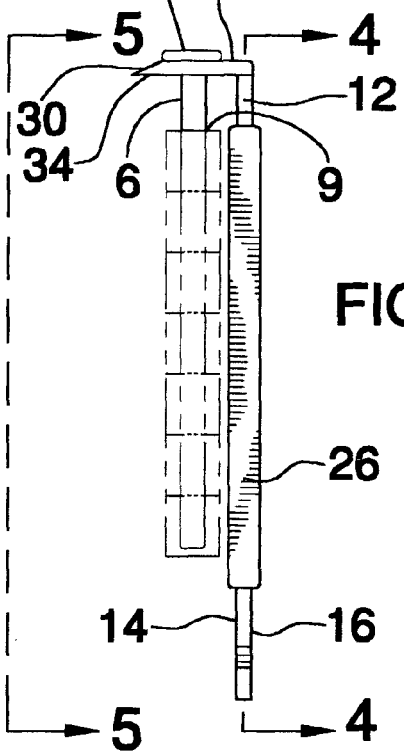
FIG. 2 is a schematic side view of the present invention.
Figure 5:
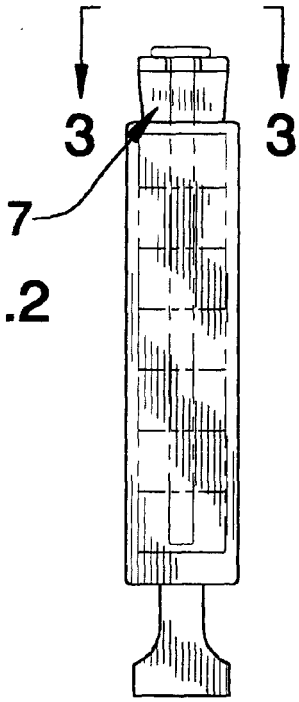
FIG. 5 is a schematic front view of the present invention.
Figure 4:
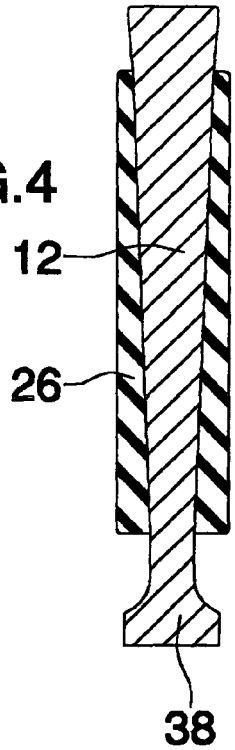
FIG. 4 is a schematic cross-sectional view taken along line 4—4 of FIG. 2 of the present invention.

With reference now to the drawings, and in particular to FIGS. 1 through 5 thereof, a new pivot pin removal device embodying the principles and concepts of the present invention and generally designated by the reference numeral 10 will be described.

As best illustrated in FIGS. 1 through 5, the pivot pin removing tool 10 generally comprises a primary plate 12 having a front side 14, a back side 16, a top edge 18, a bottom edge 20 and a pair of lateral edges 22, 24. The primary plate 12 has length from the top edge 18 to the back edge 20 generally between 4 inches and 8 inches. The primary plate 12 has a width adjacent to the top edge 18 from a first of the lateral edges 22 to a second of the lateral edges 24 generally between 1 inch and 2 inches. The width is tapered inward from the top edge 18 to the bottom edge 20. A gripping sheath 26 is positioned on and extends around the primary plate 12. The gripping sheath 26 preferably comprises an elastomeric material.

A rigid panel 28 is attached to the top edge 18 and extends away from the front side 14 at a generally perpendicular angle with respect to a longitudinal axis of the primary plate 12. The panel 28 has a forward edge 30 has a slot 32 extending therein. The slot 32 is adapted for receiving a body portion 6 of a pivot pin 7. The forward edge 30 is angled back from a bottom side 34 to a top side 36 of the panel. The panel 28 has a height from the top side 36 to the bottom side 34 generally between ⅛ inch and 3⁄16 inch.

A striking plate 38 is attached to the bottom edge 20 and extends downwardly away therefrom. The striking plate 38 is generally co-planar with the primary plate 12. The striking plate 38 has a width greater than a width of the bottom edge 20.

In use, the angled forward edge 30 is forced between the head 8 of a pivot pin 7 and the body of the hinge 9 to bias the pivot pin 7 upwards. This exposes the body portion 6 of the pin 7 so that it may enter the slot 32. The striking plate 38 may be struck with a hammer or other tool to force the pivot pin out of the hinge.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for removing a pivot pin from a hinge, said tool comprising;

a primary plate having a front side, a back side, a top edge, a bottom edge and a pair of lateral edges;

a rigid panel being attached to said top edge and extending away from said front side at a generally perpendicular angle with respect to a longitudinal axis of said primary plate, said panel having a forward edge having a slot extending therein, said slot being adapted for receiving a body portion of the pivot pin, said forward edge being angled back from a bottom side to a top side of said panel; and a striking plate being attached to said bottom edge, said striking plate being generally co-planar with said primary plate, said striking plate having a width greater than a width of said bottom edge.

2. The tool of claim 1, wherein said primary plate has length from said top edge to said back edge generally between 4 inches and 8 inches, said primary plate having a width adjacent to said top edge from a first of said lateral edges to a second of said lateral edges generally between 1 inch and 2 inches, said width being tapered inward from said top edge to said bottom edge.

3. The tool of claim 1, wherein said panel has a height from said top side to said bottom side generally between 1/8 inch and 3/16 inch.

4. The tool of claim 1, further including a gripping sheath being positioned on and extending around said primary plate.

5. The tool of claim 4, wherein said gripping sheath comprises an elastomeric material.

6. A tool for removing a pivot pin from a hinge, said tool comprising:

a primary plate having a front side, a back side, a top edge, a bottom edge and a pair of lateral edges, said primary plate having length from said top edge to said back edge generally between 4 inches and 8 inches, said primary plate having a width adjacent to said top edge from a first of said lateral edges to a second of said lateral edges generally between 1 inch and 2 inches, said width being tapered inward from said top edge to said bottom edge;

a rigid panel being attached to said top edge and extending away from said front side at a generally perpendicular angle with respect to a longitudinal axis of said primary plate, said panel having a forward edge having a slot extending therein, said slot being adapted for receiving a body portion of the pivot pin, said forward edge being angled back from a bottom side to a top side of said panel, said panel having a height from said top side to said bottom side generally between 1/8 inch and 3/16 inch;

a gripping sheath being positioned on and extending around said primary plate, said gripping sheath comprising an elastomeric material; and a striking plate being attached to said bottom edge, said striking plate being generally co-planar with said primary plate, said striking plate having a width greater than a width of said bottom edge.

* * * * *